XXXX029 0294 -00 06-12-79 22606 05-08-79 180000 78147.0 04157868 0844

United States Patent [19]

Needleman

[11] 4,157,868

[45] Jun. 12, 1979

[54] PHOTOGRAPHIC PROCESSING TRAY

[76] Inventor: Samuel Needleman, 177 Louis St., Maywood, N.J. 07607

[21] Appl. No.: 808,078

[22] Filed: Jun. 20, 1977

[51] Int. Cl.[2] ..... G03D 13/04

[52] U.S. Cl. ..... 354/307; 354/327; 354/331; 220/20

[58] Field of Search ..... 354/307, 312, 315, 326, 354/327, 328, 331, 333, 335, 336, 337, 338; 220/20, 69, 70; 366/219, 239

[56] References Cited

U.S. PATENT DOCUMENTS

| | | | |
|---|---|---|---|
| 786,266 | 4/1905 | Cartmell | 354/337 |
| 880,863 | 3/1908 | Crosby | 354/335 |
| 979,858 | 12/1910 | Hotze | 354/337 |
| 1,103,076 | 7/1914 | Quidas | 354/331 |
| 2,268,457 | 12/1941 | Moore | 354/337 |
| 2,508,886 | 5/1950 | Morse | 354/331 |
| 2,725,806 | 12/1955 | Shore | 354/336 |
| 2,917,764 | 12/1959 | Whittle | 220/20 X |
| 3,422,979 | 1/1969 | Carlson et al. | 354/336 |
| 3,465,664 | 9/1969 | Bochman | 354/331 |
| 3,903,540 | 9/1975 | Hampl | 354/315 |

FOREIGN PATENT DOCUMENTS

| | | | |
|---|---|---|---|
| 172542 | 8/1905 | Fed. Rep. of Germany | 354/331 |
| 330878 | 4/1903 | France | 354/331 |
| 8040 of | 1904 | United Kingdom | 354/331 |

*Primary Examiner*—L. T. Hix
*Assistant Examiner*—Alan Mathews
*Attorney, Agent, or Firm*—Frederick E. Bartholy

[57] ABSTRACT

A photographic developing tray is described having such configuration as to provide, when placed at an angular position, a trough adapted to contain a certain amount of processing solution. The inner wall of the trough, so formed, has a predetermined slope whereby, upon gradually moving the tray into a horizontal position, the solution contained in the trough cascades over the sloping surface onto a photographic sheet material placed on the bottom of the tray at a substantially uniform flow pattern.

1 Claim, 6 Drawing Figures

PHOTOGRAPHIC PROCESSING TRAY

FIELD OF THE INVENTION

This invention relates to the art of photography and, particularly, to the processing of photographic sheet material — be it film or paper.

In its primary aspect, the invention pertains to the constructional features of a tray to be used for the above purpose which enables an individual to perform the task of applying the various solutions in a simple and efficient manner.

In the treatment of photographic material with various solutions for the development of the latent image and fixation thereof, it is extremely important that the particular solution be uniformly applied to the emulsion surface in order to prevent uneven action of the reducing agents. Unevenness results in streaks and blemishes which cannot be readily corrected once development has progressed.

It is also important that good surface contact of the solution be achieved in order to obtain consistently satisfactory results. In the processing of multilayer material as used in color photography, it is particularly necessary that such interface contact be established between solution and emulsion surface to provide satisfactory penetration in order to uniformly develop all layers.

DESCRIPTION OF THE PRIOR ART

Trays for the processing of photographic material, such as plates, film or paper, have been used since the earliest days of photography. Such trays have been made in a variety of forms using metal, glass and, at a later date, plastic materials.

As the art developed, improvements have been made in the design of trays, among which, as far as the present invention is concerned, are those which have a storage compartment for the particular fluid used. The purpose for this was simply to permit the inspection of material as processing progressed without the need for removing the solution from the tray. The transparent tray allowed the user to hold it in a vertical position to observe the progress of development or fixation of the material while the liquid was held in the compartment. If the progress was not satisfactory, the tray was placed in a horizontal position so that the stored fluid could be quickly splashed over the material to continue its work.

As an example of such trays, attention is directed to U.S. Pat. No. 786,266 (N. Cartmell — Apr. 4, 1905) and U.S. Pat. No. 1,103,076 (F. W. Quidas — July 14, 1914). The trays are transparent to light and the purpose of the storage compartment is simply to hold the processing liquid while the material is being inspected through the transparent bottom of the tray to determine the progress being made.

A more recent example of a storage compartment type developing tray is seen in U.S. Pat. No. 3,422,979 (R. A. Carlson, et al — Jan. 21, 1969).

It is to be noted that the purpose of the compartment in prior art devices is merely to store the liquid when the tray is in a predetermined position and return it to the work area in another position.

Attention is also called to my U.S. Pat. No. 3,601,029, disclosing a processing apparatus which applies processing solution in a "laminar flow" over the surface of the photographic sheet material.

SUMMARY OF THE INVENTION

It is the primary object of the invention to provide a tray for the processing of photographic sheet material having such constructional features which enable the user to obtain substantially uniform application of the particular processing fluid on the material placed in the tray.

It is a distinct feature of the invention that, by virtue of the constructional features, when the tray is in a predetermined position, a trough is formed for accepting a quantity of processing solution. When the tray is placed in another position, the solution is applied to the material to be processed in a uniform flow pattern.

It is a particular advantage of the invention that the tray for all practical purposes is completely light sealed by a cover, so that solutions may be introduced or removed without necessitating the lifting of the cover. Thus the processing operation may be effected in daylight or under any desired lighting conditions.

Other objects, features, and advantages will be apparent from the following description of the invention, pointed out in particularity in the appended claims, and taken in connection with the accompanying drawings, in which:

Prior to referring to the figures, let it be understood that the purpose of the invention is not to provide a handy tray which the user may tilt from one position to another so as to slush a solution placed therein to his heart's content without spilling it. Granted that the user may do so if he is not interested in the ultimate result.

To the contrary, as will be seen upon describing the constructional features shown in the figures, by proper use, the tray contributes to the even, uniform development of large size sheet materials without streaks or blemishes. Except for the placing of the material to be processed into the tray, all further operations may be effected in daylight.

Figure 1:
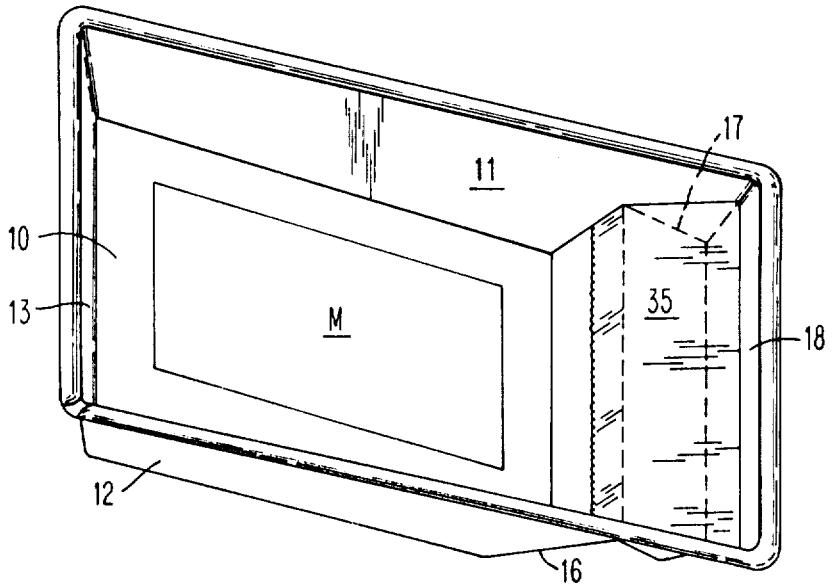
FIG. 1 is a view, in perspective, of the tray constructed in accordance with the invention placed at an angular position.
Figure 2:
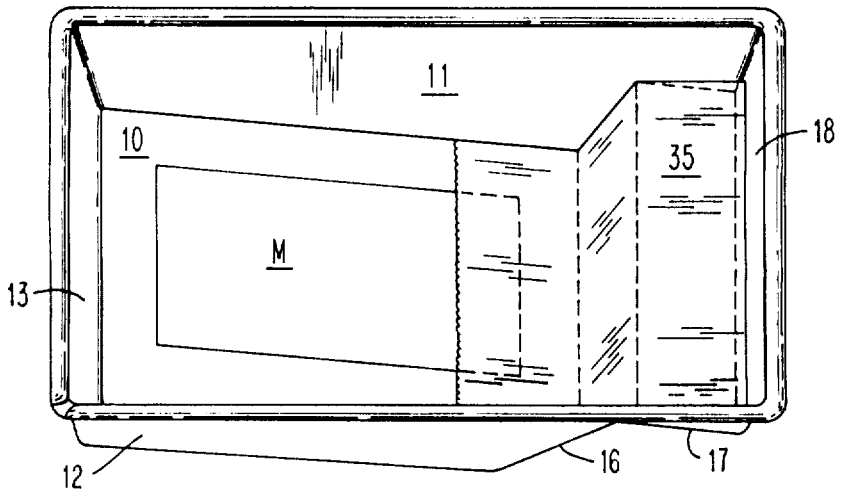
FIG. 2 is a view similar to that of FIG. 1 with the tray tilted toward the horizontal position.
Figure 3:
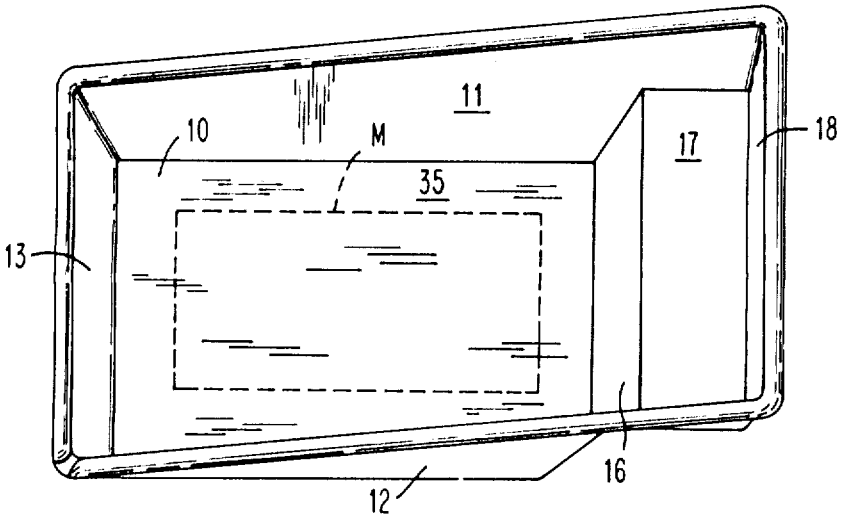
FIG. 3 is a view of the tray in a horizontal position.

As seen in FIGS. 1, 2 and 3, the tray comprises a bottom wall 10, side walls 11 and 12, and a front wall 13 extending therefrom in a substantially vertical direction. A portion 16 of the rear wall 18 extends from the base 10 at an obtuse angle (as measured from the inside), and terminates in a horizontal platform 17 within the confines of the tray. Experiments have shown that an angle of approximately 120° gives excellent results.

The rear wall portion 18 extends to a distance completing the height of the walls 11, 12 and 13, thereby forming a unitary structure, namely, a tray. The upper edges of the walls are turned down so as to present a rounded surface upon which, as will be seen, a suitable cover (shown in FIG. 5) may be placed to form a light-tight structure.

Figure 4:
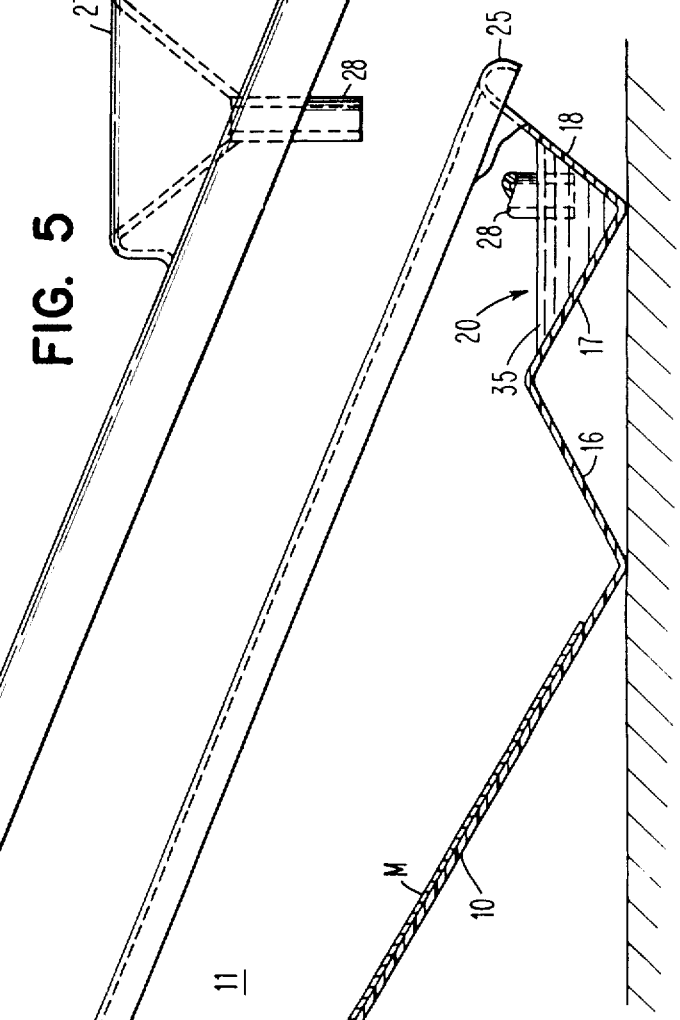
FIG. 4 is a sectional side view of the tray placed in an angular position.
Figure 1:
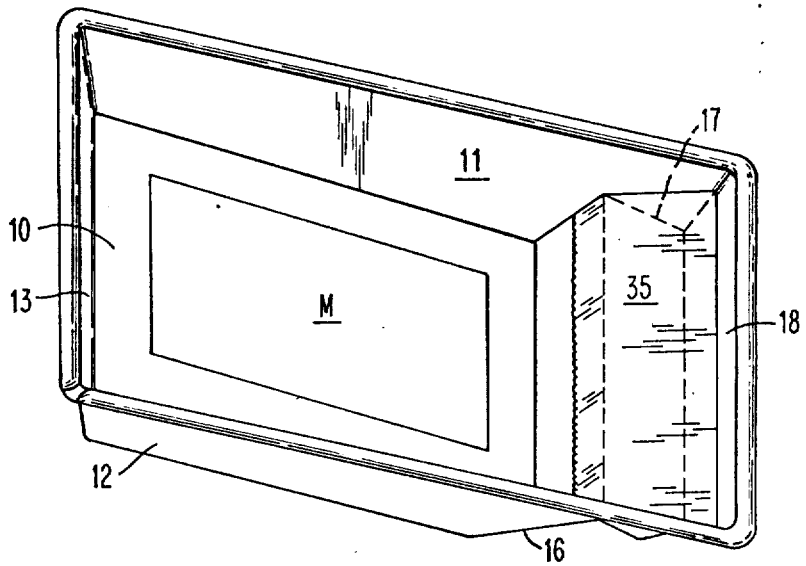
Figure 2:
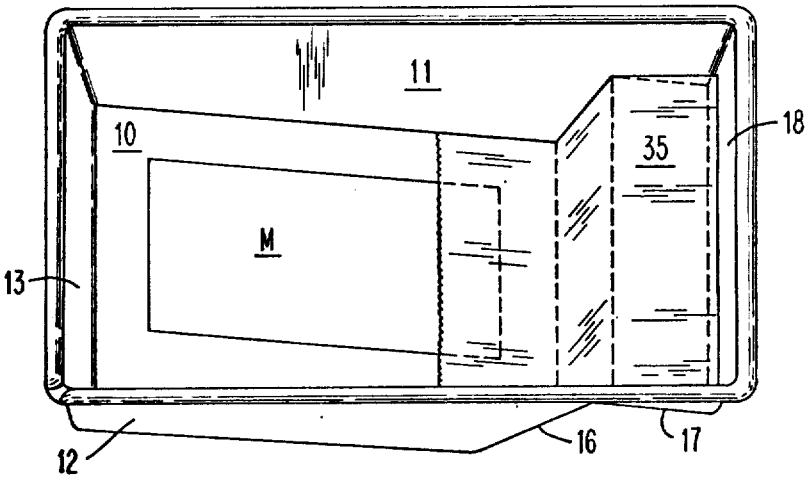
Figure 3:
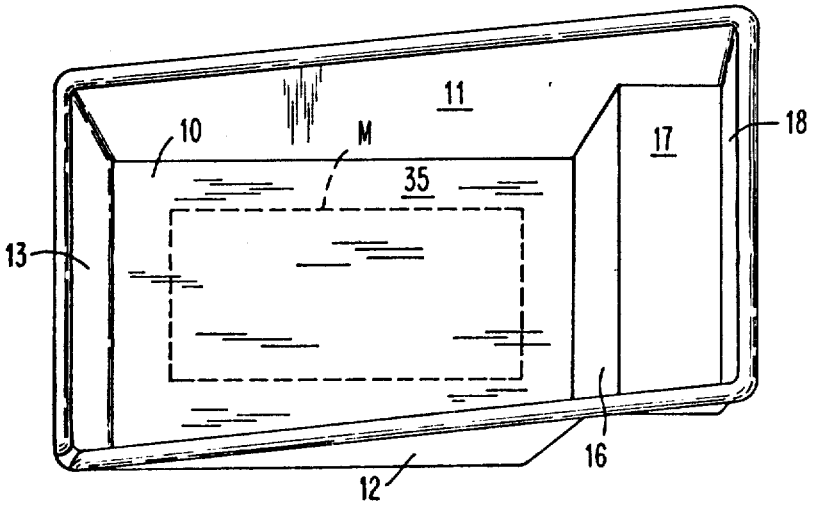
Figure 6:
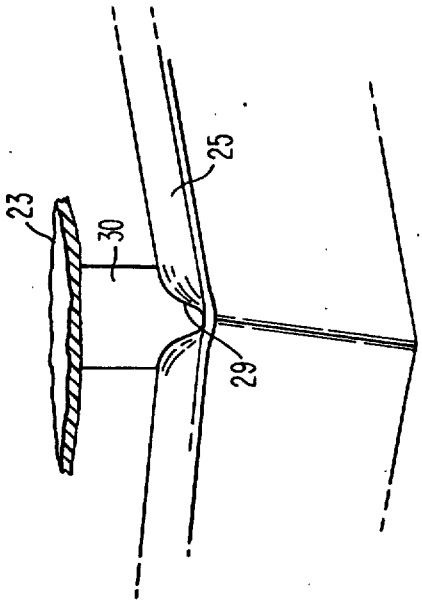
Figure 5:
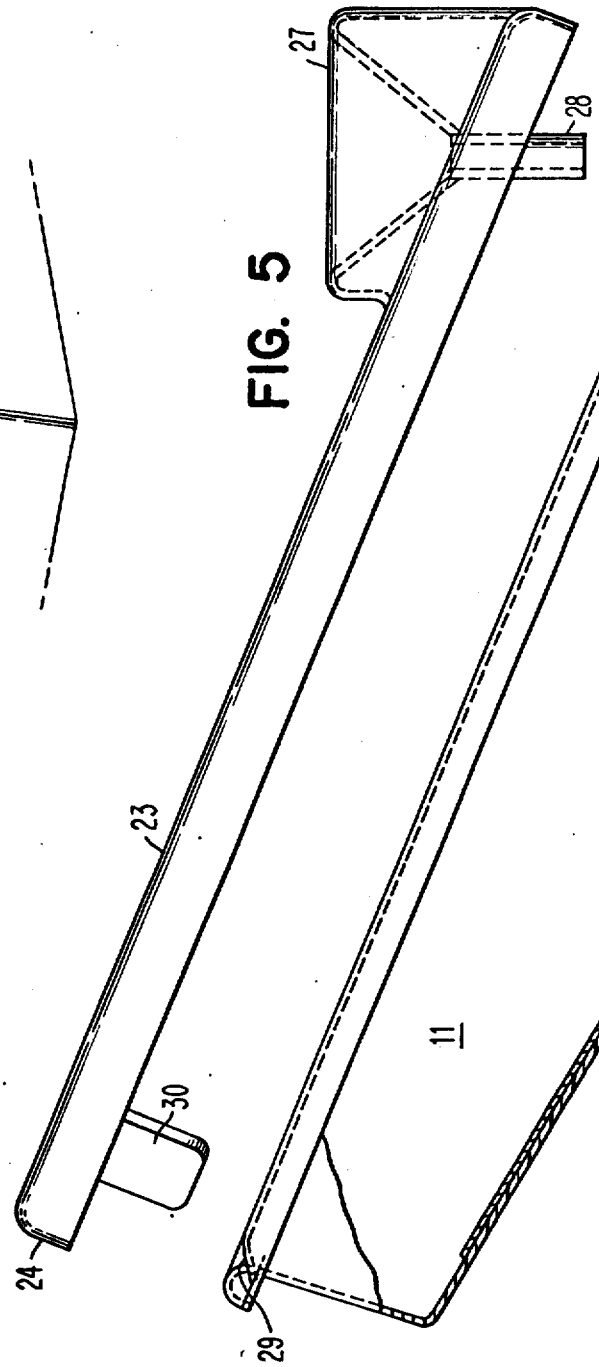
Figure 4:
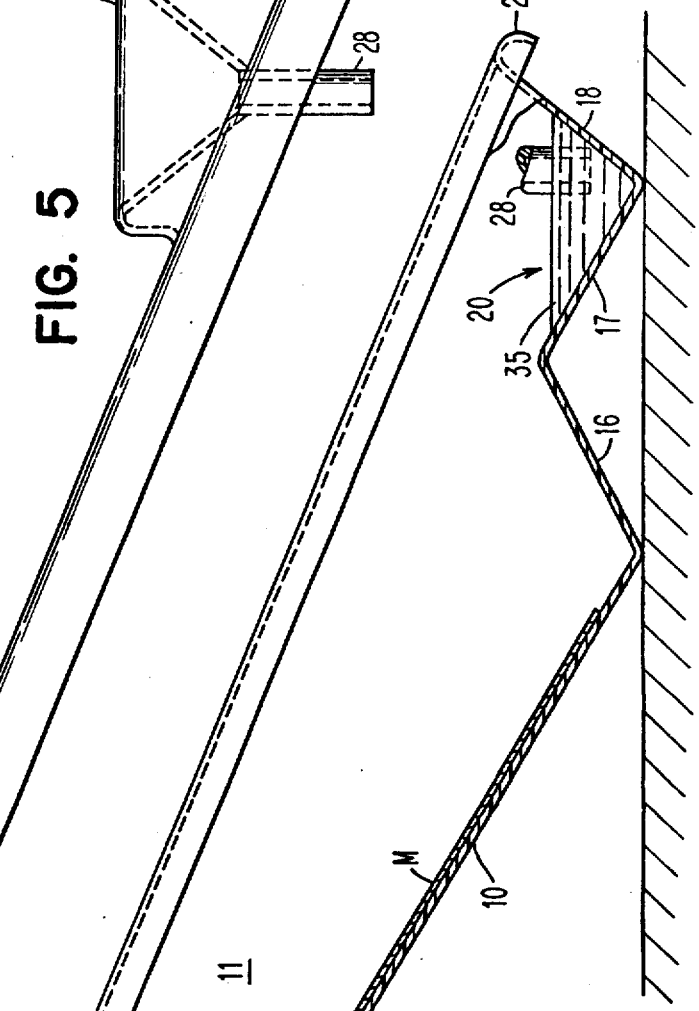

Referring to FIG. 4, the sectional view shows the tray placed at an angular position, illustrating the formation of a trough 20 by the wall portion 16, the platform 17, and the wall portion 18.

Figure 5:
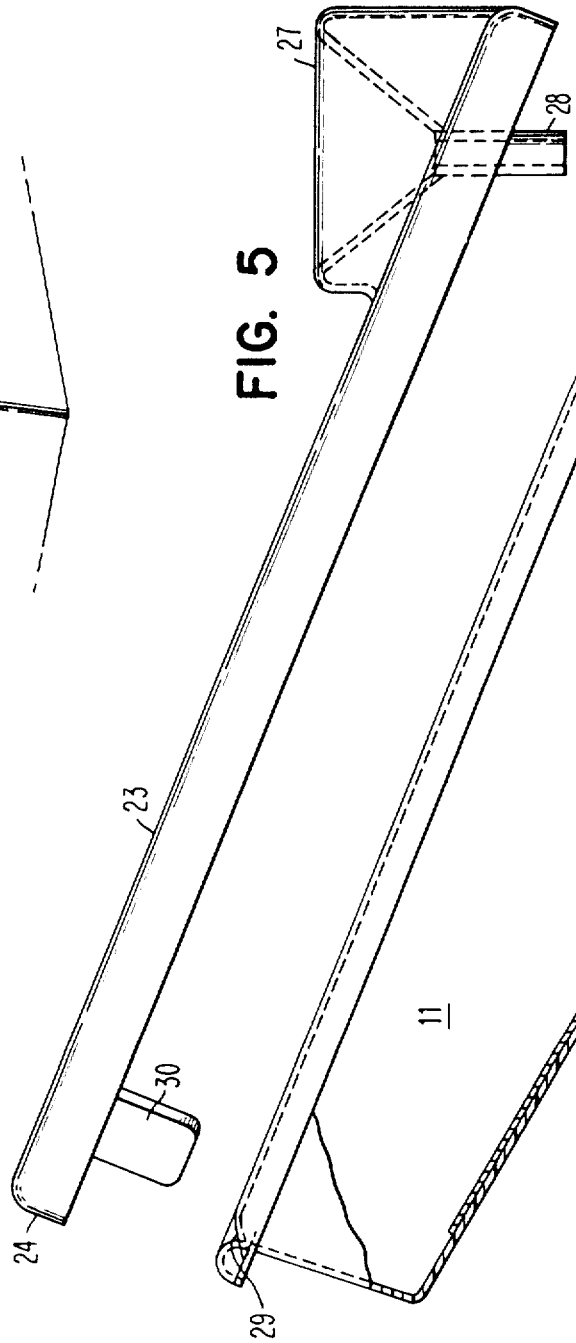
FIG. 5 is a side elevational view of the cover placed in relation to the tray in FIG. 4.

In FIG. 5, it is seen that a cover 23 has side walls 24 which fit over the turned-down edges 25 of the tray. The cover 23 has a funnel-shaped portion 27 extending therefrom. When the cover is solidly placed on the tray, the tubular spout 28 thereof extends into the trough 20 for the purpose of introducing various liquids. This trough and spout relationship acts as a light trap preventing light from reaching the material "M" placed on the bottom of the tray.

Figure 6:
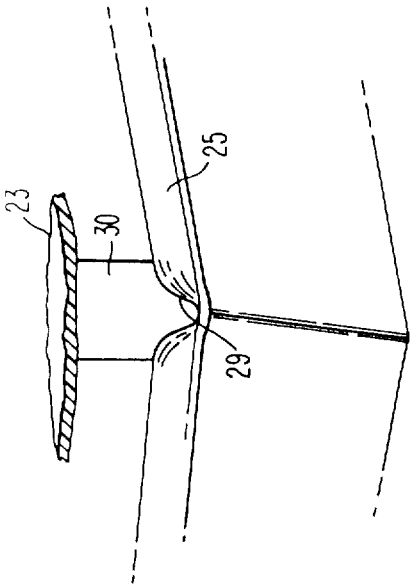
FIG. 6 is a partial view of one corner of the tray and a sectional view of a portion of the cover showing the light sealing baffle plate.

At a desired location, as seen in FIG. 6, the rounded surface 25 of the tray has an indentation 29 which forms a lip for the purpose of removing solution from the trough 20 formed in the tray.

In order to insure a light seal, the cover 23 has a downwardly-extending baffle plate 30 at the corner where the lip is formed. In this manner, no light can enter at the opening in the solid structure of the tray.

Referring to the use of the tray in accordance with the invention, let us first examine the position of the tray as shown in FIG. 4. It will be observed that it is tilted and, of course, held in this position by the user, so that it rests on the edges formed by the rear wall portion 16 and the platform 17. In this position, the latter, together with the wall 18, forms the storage trough 20 into which a measured amount of processing solution 35 is introduced by way of the spout 28 of the funnel portion 27.

It is, of course, assumed that, prior to this operation, a darkroom, i.e., an environment of total darkness, has been utilized when placing the sheet material "M" to be processed in the bottom of the tray.

To effect the processing operation, the tray with the cover in place is now slowly tilted by the user in the direction to lay flat on the support on which it is placed.

Experiments have shown that, as the tray is lowered, for example as shown in FIG. 1, the solution 35 is constrained to cascade over the sloping surface of the wall 16 in a substantially uniform flow pattern.

In FIG. 2, it is seen that the solution 35 has progressed partially over the material "M". The flow pattern is uniform. Finally, as seen in FIG. 3, the entire sheet "M" is covered with the solution, thus a uniform action of the particular reducing agent, be it developer or fixer, is exerted on the sheet material being processed.

By virtue of the flow pattern achieved by the use of the tray, streaks and blemishes are eliminated. Even development of a photographic sheet material may be obtained by the simple manipulation of gradually tilting the tray from an angular starting position to a flat resting position.

No particular skill, nor elaborate machinery for applying the required solution uniformly over large size sheet materials, for example 8 × 10 or 16 × 20 sheets, are needed. In normal hand manipulation in a darkroom, this would be extremely difficult to achieve.

When the time required for the action of the solution has expired — such time being determined by the specifications set by the manufacturers of the particular materials — the tray is tilted to such a position that the liquid flows out at the location of the spout.

For introducing the next required solution, the tray is tilted into the position shown in FIG. 4 and refilled through the funnel portion 27 for the ensuing operation.

All of the steps hereinabove described, except for the placing of the photographic material into the tray, may be effected in daylight or other ambient light conditions, inasmuch as the tray, with the cover in place, is light tight. Solutions may be removed and introduced by simple manipulation of the tray by the user.

The invention in its broader aspects is not limited to the specific embodiments herein shown and described but changes may be made within the scope of the accompanying claims without departing from the principles of the invention and without sacrificing its chief advantages.

What is claimed is:

1. A photographic processing tray assembly for processing photographic sheet material under lighted conditions, said tray assembly comprising:

a tray having a horizontal bottom surface, side walls extending upwardly from said bottom, a rear wall portion joined at a first end to a second end of said bottom and extending upwardly at an angle of approximately 120° therefrom, a horizontal tray portion joined at a first end to a second end of said rear wall portion and extending away from and generally parallel to said bottom, and a rear wall extending upwardly from a second end of said horizontal platform, said rear wall and said horizontal platform forming a trough for the receipt of a photographic processing solution when said front wall is elevated to incline said bottom surface;

a plurality of rounded surfaces formed on the upper ends of said front, side, and rear walls, said rounded surfaces extending outwardly and downwardly from said walls;

an indention formed in said rounded surfaces at an intersection of two of said walls, said indentation serving as a pour spout for removing said processing solution from said tray; and a cover for said tray, said cover including down turned edges which fit over said rounded surfaces to prevent light from entering said tray, and a funnel shaped opening in said cover communicating with a downwardly extending tube extending into said tray adjacent said horizontal platform to facilitate placement of said solution into said trough, whereby photographic sheet material may be placed on said bottom surface, said front wall of said tray may be elevated, said solution may be placed in said trough through said funnel, said tray may be returned to a horizontal position to cause said solution to flow in a uniform manner from said trough down said rear wall portion onto said sheet material to process said material and said solution may then be removed from said tray by being poured out through said spout.

* * * * *

UNITED STATES PATENT AND TRADEMARK OFFICE

CERTIFICATE OF CORRECTION

PATENT NO. : 4,157,868

DATED : June 12, 1979

INVENTOR(S) : Samuel Needleman

It is certified that error appears in the above-identified patent and that said Letters Patent are hereby corrected as shown below:

The title page up to and including the two sheets of drawings should be deleted to insert the attached respectively therefor.

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*

United States Patent [19]

Needleman

[11] 4,157,868

[45] Jun. 12, 1979

[54] PHOTOGRAPHIC PROCESSING TRAY

[76] Inventor: Samuel Needleman, 177 Louis St., Maywood, N.J. 07607

[21] Appl. No.: 808,078

[22] Filed: Jun. 20, 1977

[51] Int. Cl.[2] ..... G03D 13/04

[52] U.S. Cl. ..... 354/307; 354/327; 354/331; 220/20

[58] Field of Search ..... 354/307, 312, 315, 326, 354/327, 328, 331, 333, 335, 336, 337, 338; 220/20, 69, 70; 366/219, 239

[56] References Cited

U.S. PATENT DOCUMENTS

| | | | |
|---|---|---|---|
| 786,266 | 4/1905 | Cartmell | 354/337 |
| 880,863 | 3/1908 | Crosby | 354/335 |
| 979,858 | 12/1910 | Hotze | 354/337 |
| 1,103,076 | 7/1914 | Quidas | 354/331 |
| 2,268,457 | 12/1941 | Moore | 354/337 |
| 2,508,886 | 5/1950 | Morse | 354/331 |
| 2,725,806 | 12/1955 | Shore | 354/336 |
| 2,917,764 | 12/1959 | Whittle | 220/20 X |
| 3,422,979 | 1/1969 | Carlson et al. | 354/336 |
| 3,465,664 | 9/1969 | Bochman | 354/331 |
| 3,903,540 | 9/1975 | Hampl | 354/315 |

FOREIGN PATENT DOCUMENTS

| | | | |
|---|---|---|---|
| 172542 | 8/1905 | Fed. Rep. of Germany | 354/331 |
| 330878 | 4/1903 | France | 354/331 |
| 8040 of | 1904 | United Kingdom | 354/331 |

*Primary Examiner*—L. T. Hix
*Assistant Examiner*—Alan Mathews
*Attorney, Agent, or Firm*—Frederick E. Bartholy

[57] ABSTRACT

A photographic developing tray is described having such configuration as to provide, when placed at an angular position, a trough adapted to contain a certain amount of processing solution. The inner wall of the trough so formed, has a predetermined slope whereby, upon gradually moving the tray into a horizontal position, the solution contained in the trough cascades over the sloping surface onto a photographic sheet material placed on the bottom of the tray at a substantially uniform flow pattern.

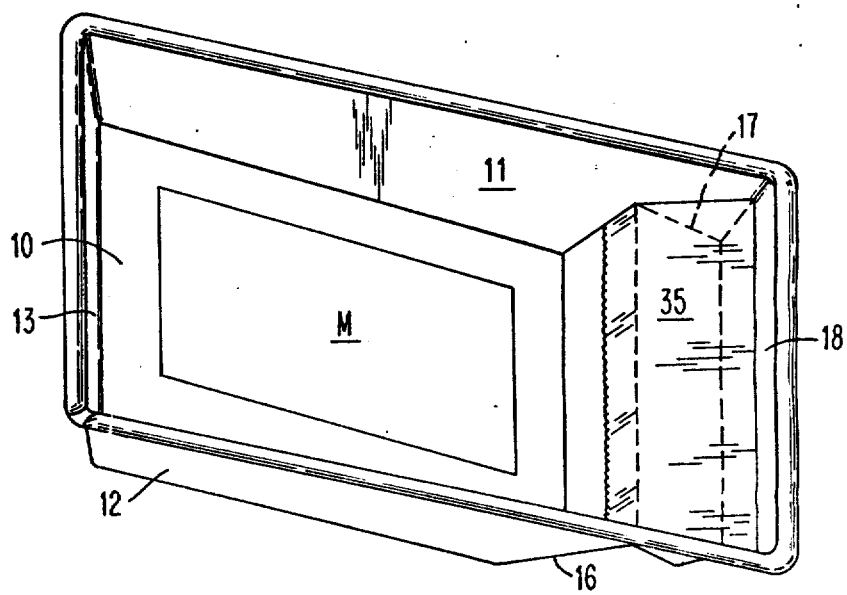

1 Claim, 6 Drawing Figures